US012611033B2

(12) United States Patent
Forgy et al.

(10) Patent No.: US 12,611,033 B2
(45) Date of Patent: Apr. 28, 2026

(54) CHAIR MECHANISM WITH SELECTIVE AUTO-ROCKING CAPABILITY

(71) Applicant: L&P Property Management Company, South Gate, CA (US)

(72) Inventors: David Forgy, Aurora, MO (US); Ronald D. Davis, Joplin, MO (US); David Purser, Carthage, MO (US); Tony Diggs, Carthage, MO (US); Caleb Browning, Carthage, MO (US)

(73) Assignee: L&P Property Management Company, Carthage, MO (US)

( * ) Notice: Subject to any disclaimer, the term of this patent is extended or adjusted under 35 U.S.C. 154(b) by 141 days.

(21) Appl. No.: 18/378,027

(22) Filed: Oct. 9, 2023

(65) Prior Publication Data

US 2024/0122347 A1 Apr. 18, 2024

Related U.S. Application Data

(60) Provisional application No. 63/416,797, filed on Oct. 17, 2022.

(51) Int. Cl.
*A47C 3/025* (2006.01)
*A47C 3/03* (2006.01)

(52) U.S. Cl.
CPC ..... *A47C 3/0251* (2018.08); *A47C 3/0252* (2013.01); *A47C 3/03* (2013.01)

(58) Field of Classification Search
CPC .... A47C 3/0251; A47C 3/0252; A47C 3/0255
See application file for complete search history.

(56) References Cited

U.S. PATENT DOCUMENTS

| | | | | |
|---|---|---|---|---|
| 3,019,052 | A * | 1/1962 | Zawadzki | A47C 3/027 601/24 |
| 6,152,529 | A | 11/2000 | Beason | |
| 8,177,296 | B2 | 5/2012 | Shih | |
| 9,993,081 | B1 * | 6/2018 | McLellen | A47C 3/0255 |
| 2011/0248535 | A1 | 10/2011 | LaPointe | |
| 2012/0212022 | A1 * | 8/2012 | Godbout | A47C 3/025 297/260.1 |
| 2014/0191548 | A1 | 7/2014 | McLellen | |

FOREIGN PATENT DOCUMENTS

| | | | | |
|---|---|---|---|---|
| CA | 2769052 | A1 * | 8/2012 | A47C 3/02 |
| JP | 2000116711 | A * | 4/2000 | A47C 1/025 |
| WO | WO-2019137955 | A1 * | 7/2019 | A47C 1/022 |

OTHER PUBLICATIONS

International Preliminary Report on Patentability received for PCT Patent Application No. PCT/US2023/076939, mailed on May 1, 2025, 9 pages.
International Search Report and Written Opinion received for PCT Patent Application No. PCT/US2023/076939, mailed on Mar. 4, 2024, 17 pages.
Invitation to Pay Additional Fees received for PCT Patent Application No. PCT/US2023/076939, mailed on Dec. 12, 2023, 2 pages.

* cited by examiner

*Primary Examiner* — Timothy J Brindley
(74) *Attorney, Agent, or Firm* — SHOOK, HARDY & BACON L.L.P.

(57) ABSTRACT

A mechanism for a seating unit is provided that allows a reclining mechanism to freely rock on a rocker assembly when a locking actuator is in a first position, and that provides an auto-rocking motion, via a rocking actuator, when the locking actuator is in a second position.

16 Claims, 6 Drawing Sheets

CHAIR MECHANISM WITH SELECTIVE AUTO-ROCKING CAPABILITY

CROSS-REFERENCE TO RELATED APPLICATIONS

This application claims the benefit of U.S. Provisional Application No. 63/416,797, filed Oct. 17, 2022, entitled Chair Mechanism with Selective Auto-Rocking Capability, the entirety of which is incorporated by reference herein.

TECHNICAL FIELD

Aspects herein relate to a chair and a mechanism for use on a chair that allows both manual and motorized rocking.

BACKGROUND

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "recliners." Further, aspects disclosed herein relate to rocker-recliners that provide a rocking motion. More particularly, the present invention relates to a rocker-recliner allowing a user to either manually rock the chair or to engage a mechanism to provide a powered rocking motion.

Recliners exist that typically provide three basic positions: a normal non-reclined sitting position with the seat generally horizontal and the back substantially upright; a partially reclined position often referred to as a "TV" position with an extended ottoman and with the seat and back disposed in a slightly reclined position but with the back still sufficiently upright to permit comfortable television viewing from the recliner; and a fully reclined position with the back pivoted toward horizontal into an obtuse relationship with the seat for lounging or sleeping. Additionally, recliners exist that have a rocker base that allows a user to rock the seat and back of the recliner. However, it would be desirable to provide a mechanism that powers this rocking motion, such that the user does not need to provide the energy needed for the rocking motion.

BRIEF DESCRIPTION OF THE DRAWINGS

Examples of aspects herein are described in detail below with reference to the attached drawings figures, wherein.

DETAILED DESCRIPTION

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies.

Figure 1:
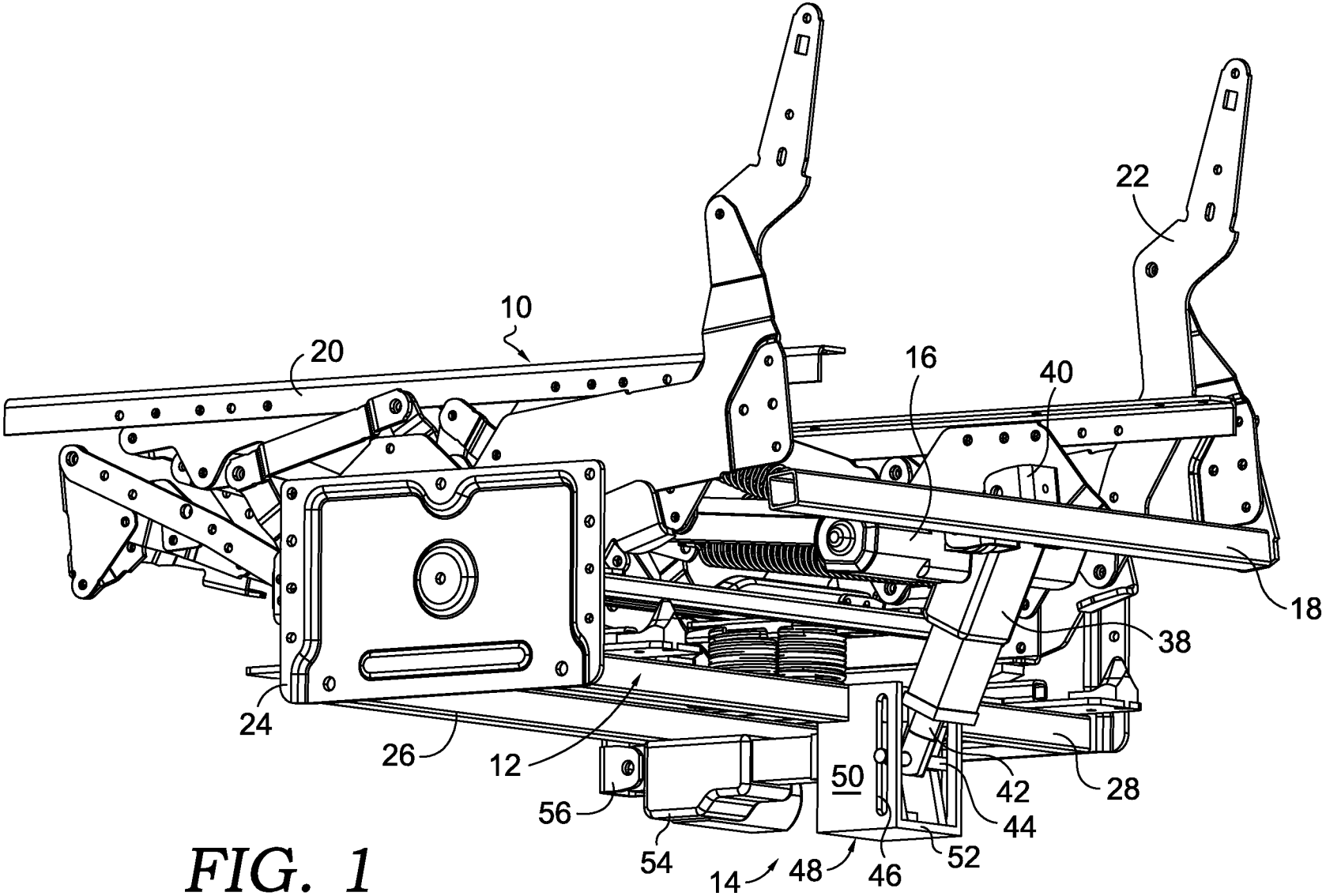
FIG. 1 illustrates a perspective view of a rocker-recliner mechanism in the closed position, in accordance with aspects herein.
Figure 2:
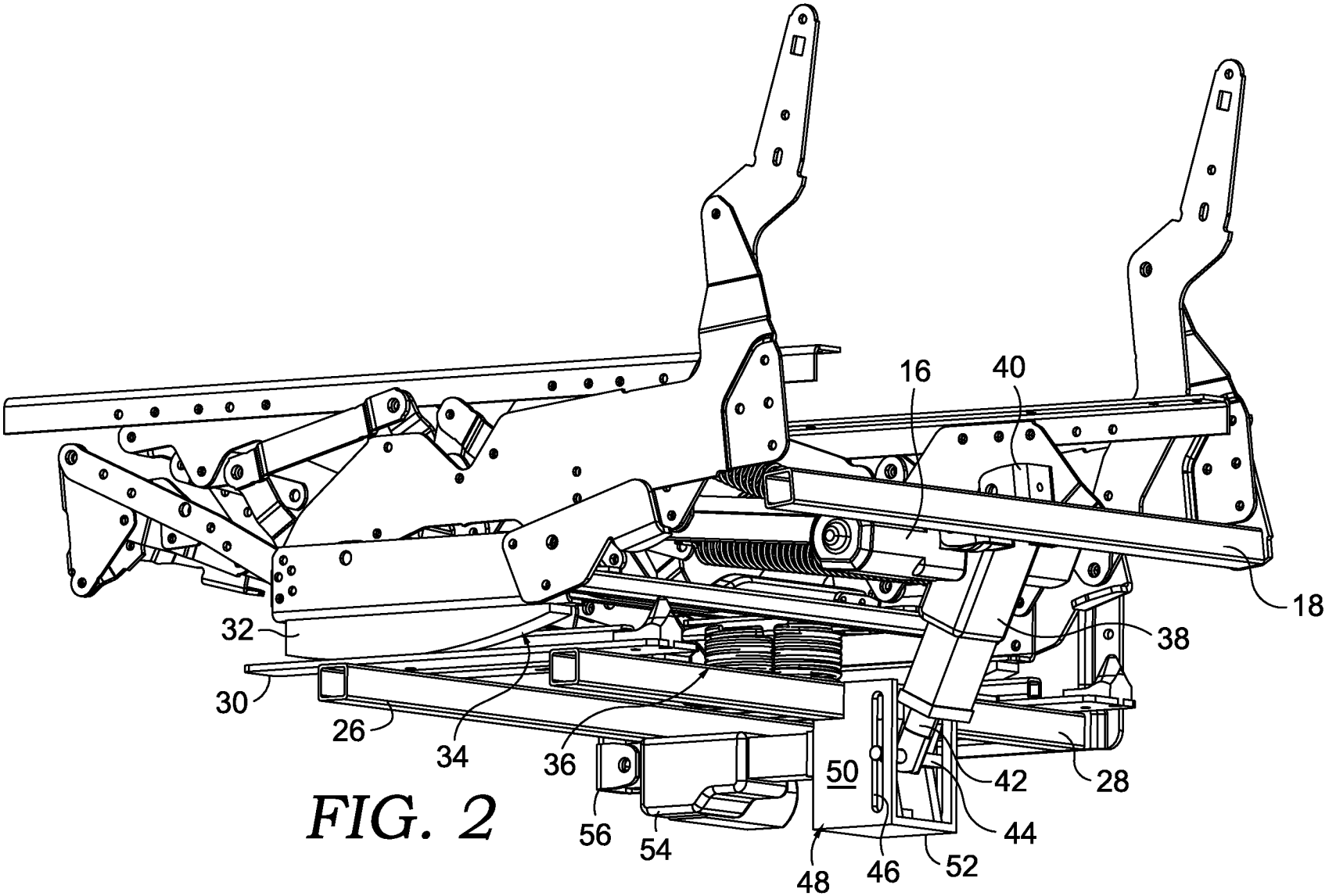
FIG. 2 illustrates a perspective view similar to FIG. 1, but shown with an arm mounting plate hidden from view, in accordance with aspects herein.

FIGS. 1-5 depict a chair mechanism 10 in a closed position. The chair mechanism 10 is shown without the finished seat, ottoman, arms, legs and back. Those of skill in the art will recognize that different finishes and looks are achievable in building a completed chair. The chair mechanism 10 includes a rocker-recliner mechanism 12 and an auto-rocker assembly 14. The rocker-recliner mechanism 12 is shown as a powered unit with a motor (such as a linear actuator) 16 that is operable to move the mechanism 12 between closed, TV and fully-reclined positions. Such a mechanism is known in the art. The motor 16 is coupled to the mechanism 12 via a rear motor tube 18 that spans between each side of the mechanism 12. The rear motor tube 18 is coupled, either directly or indirectly through a series of links, to a seat plate 20 and a back bracket 22. In one aspect, the mechanism 12 is coupled to the arms of the chair via an arm mounting plate 24 that is on each side of the mechanism 12. A front chassis tube 26 and a rear chassis tube 28 extend between the arm mounting plates 24. The front chassis tube 26 and the rear chassis tube 28 are, in some aspects, rigidly coupled to the arm mounting plates 24. As best seen in FIG. 2, the front chassis tube 26 and the rear chassis tube 28 support a lower cam plate 30 that is fixedly coupled to the front and rear chassis tubes 26, 28 respectively. The lower cam plate 30, in turn, supports a rocker cam 32 on each side of the mechanism 12. The rocker cams 32 are part of a rocker assembly, designated as 34 in the figures. The rocker assembly 34 supports the remainder of the mechanism 12 and uses springs 36 that allow a user to rock the seat and chair back using their legs or body motion, while the arm mounting plates 24, front chassis tube 26, rear chassis tube 28 and the lower cam plates 30 remain stationary. The mechanism 12 and the rocker assembly 34 can be any of a number of existing powered or manual mechanisms that provide a rocker and recliner functionality.

Figure 3:
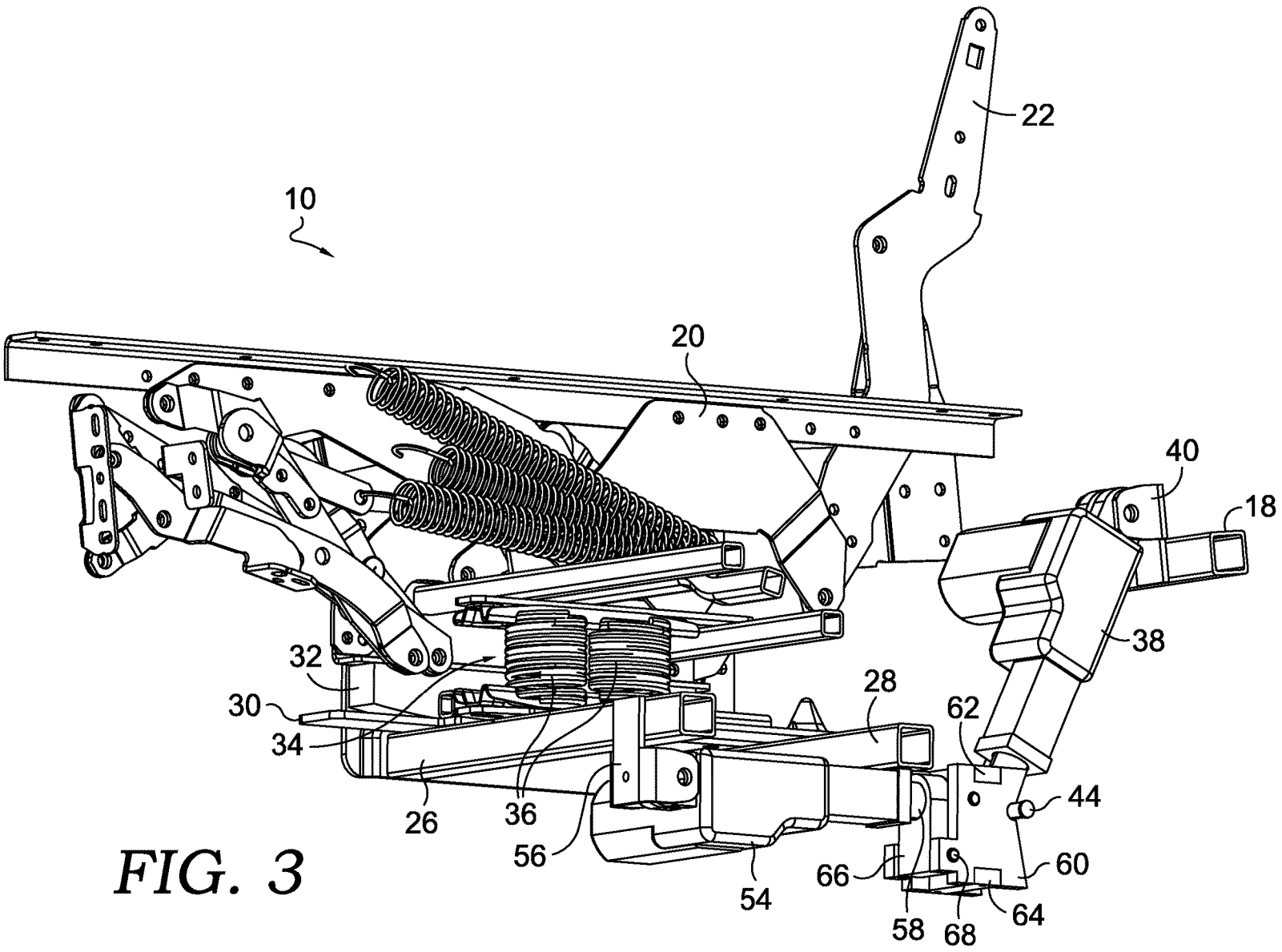
FIG. 3 illustrates an enlarged, partial, cross-section, shown with certain parts hidden to reveal details of construction, in accordance with aspects herein.
Figure 4:
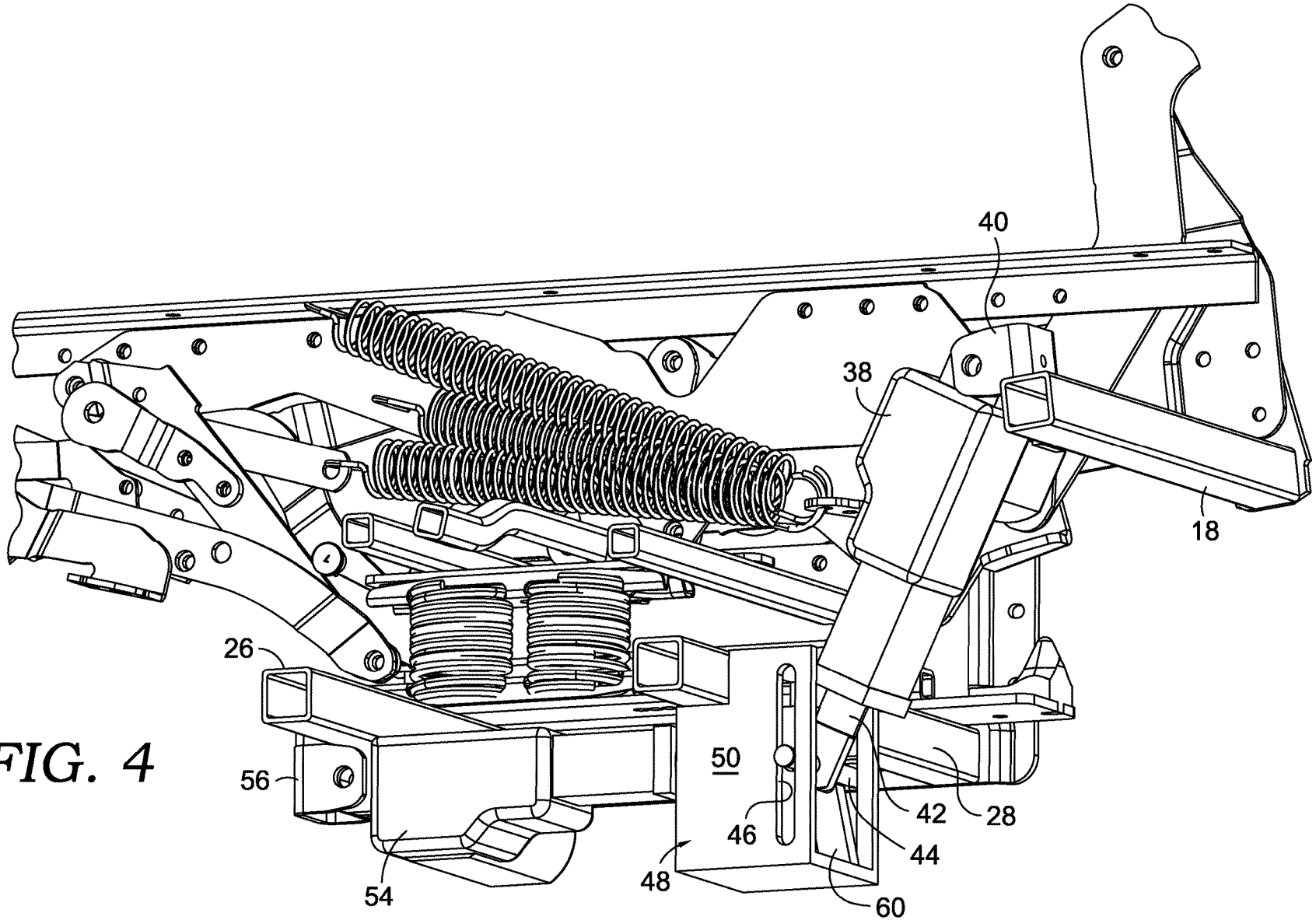
FIG. 4 is an enlarged perspective view in cross-section similar to FIG. 3, but shown with the mounting bracket also hidden to reveal details of construction, in accordance with aspects herein.

With continued reference to FIGS. 2 and 3, the auto-rocker assembly 14, in one aspect, includes a rocker actuator 38 that is pivotally coupled to the rear motor tube 18 via a bracket 40. In some aspects, the bracket 40 is welded to the rear motor tube 18. The actuator 38 is operable to extend and retract a shaft 42. The outer end of the shaft 42 has a through hole that accepts a retaining pin 44. As shown in FIGS. 1 and 2, the retaining pin 44 extends through the end of the shaft 42 and through a pair of spaced, vertical slots 46 in a mounting bracket 48. In some aspects, the retaining pin 44 can be held within the vertical slots 46 with a nut and washer (not shown) coupled to the outer ends of the retaining pin 44, although other attachment mechanisms could also be used. The upper portion of the mounting bracket 48 is rigidly coupled to the rear chassis tube 28, such as by welding. In some aspects, the mounting bracket 48 includes two side plates 50 (with the slots 46 formed therein) fixedly coupled to a bottom plate 52.

Figure 5:
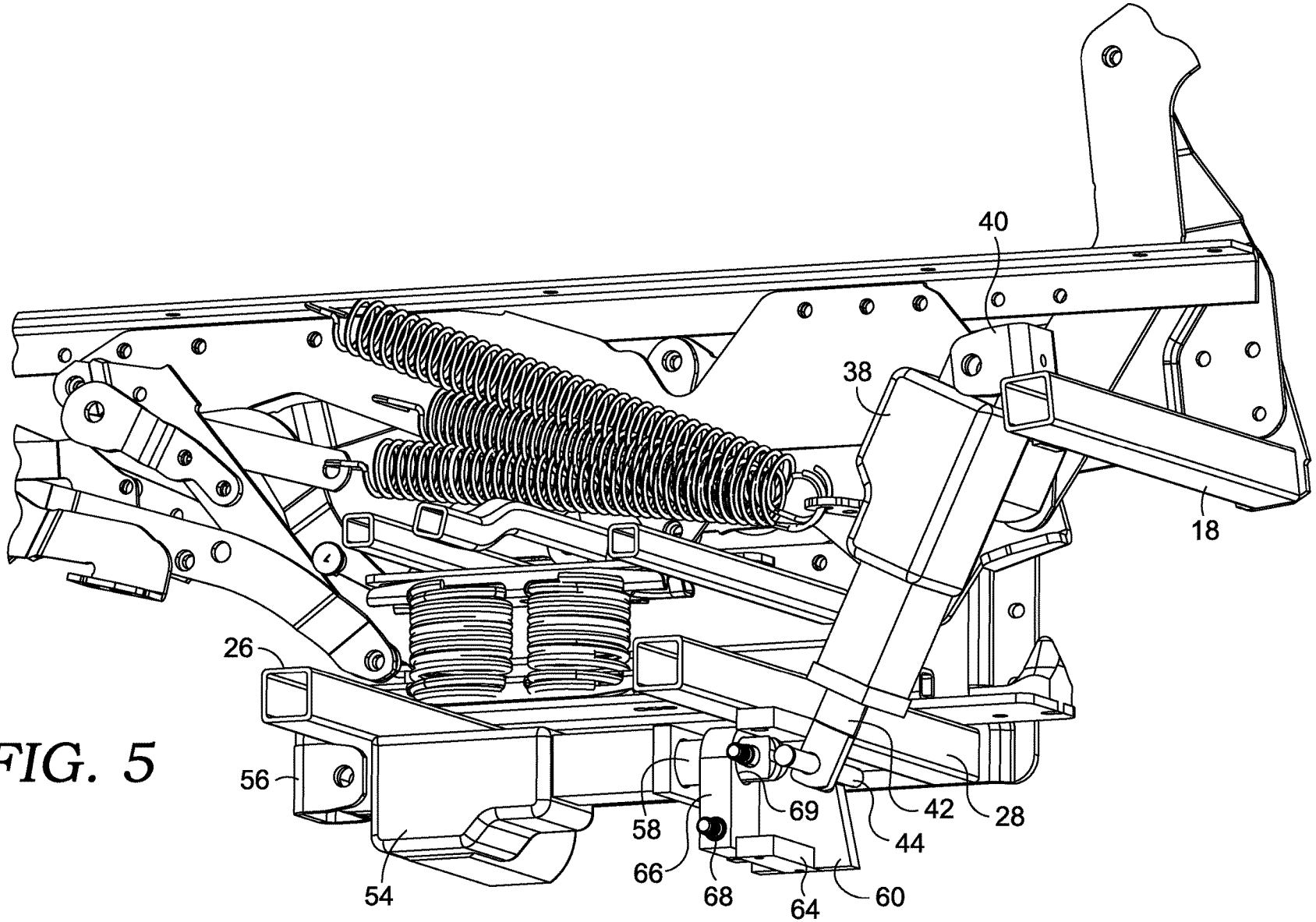
FIG. 5 is a view similar to FIG. 4, but shown with the one side plate also hidden to reveal details of construction, in accordance with aspects herein.

The auto-rocker assembly 14 also includes a locking actuator 54 that is pivotally coupled to the front chassis tube 26 via a bracket 56. In some aspects, the bracket 56 is welded to the front chassis tube 26. As seen in FIG. 3, the locking actuator 54 is operable to extend and retract a shaft 58. As shown in FIGS. 3 and 5, the end of the shaft 58 is coupled to and between a pair of spaced locking plates 60. The locking plates 60 are also fixedly coupled to one another via a top brace 62 and a bottom brace 64. In some aspects, the top brace 62 and the bottom brace 64 are bolted to the locking plates 60. The locking plates 60 are spaced to fit between the side plates 50 of the mounting bracket 48. In some aspects, the face of each locking plate 60 adjacent the side plate 50 may be made of a material that acts as a bearing surface, allowing the locking plates 60 to slide relative to the side plates 50, as further described below. Additionally, in some aspects, an actuator load distributor block 66 is coupled between the locking plates 60, such as by a shoulder bolt 68 (although other attachment mechanisms could be used). The block 66 has an upper through hole 69 through which the shaft 58 extends. The block 66 functions to stabilize the shaft 58 and to distribute the load from the locking actuator 54 as it acts on the locking plates 60.

Figure 6:
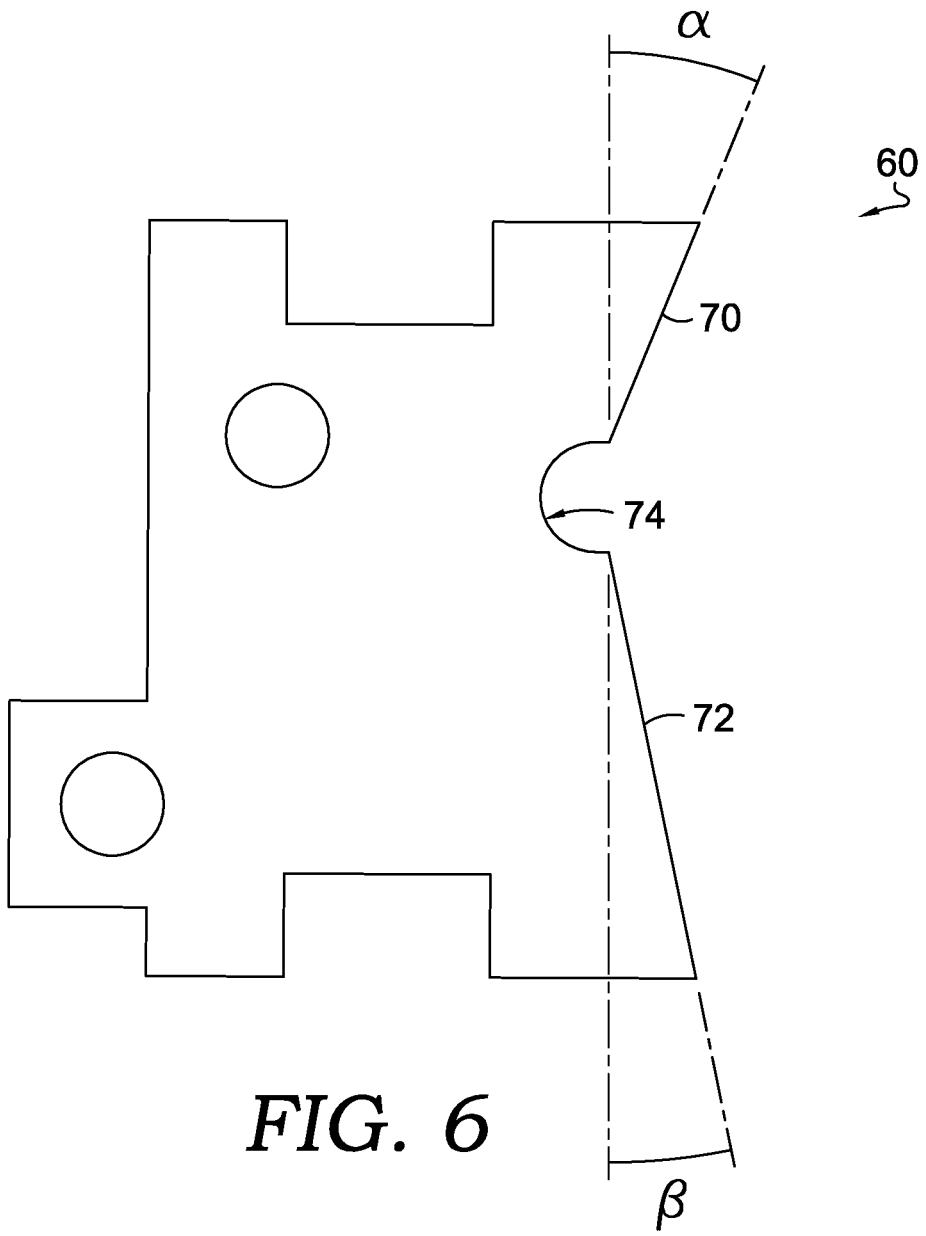
FIG. 6 is an enlarged side view of a locking plate, in accordance with aspects herein.

As best seen in FIG. 6, each locking plate 60, in some aspects, includes an angled upper face 70 and an angled lower face 72. The upper face 70 and the lower face 72 are both angled toward a locking notch 74. In some aspects, the upper face 70 is shorter in length than the lower face 72. Further, in some aspects, the angle $\alpha$ (with respect to vertical) of the upper face 70 is different from the angle $\beta$ (with respect to vertical) of the lower face 72. In some aspects, the notch 74 has a radius that matches the curvature of retaining pin 44.

The auto-rocker assembly 14 is selectively operable to allow either manual rocking motion (powered by a user) or automatic rocking motion (powered by rocking actuator 38). To allow manual rocking motion, the locking actuator 54 is engaged to retract the shaft 58 to a first state, or a first position, which moves the locking plates 60 away from the retaining pin 44. In this position, the retaining pin 44 is allowed to move vertically up and down within the vertical slots 46 on the mounting bracket 48, with the shaft 42 allowed to move freely. In this position, the rocker-recliner mechanism 12 functions like other rocker-recliner mechanisms, with the rocking motion powered by the user. To move to an auto-rocking motion, the locking actuator 54 is engaged to extend the shaft 58 to a second state or a second position, which moves the locking plates 60 toward the retaining pin 44. The upper face 70 and the lower face 72 guide the retaining pin 44 into the locking notch 74. With the retaining pin 44 held in place by the locking plates 60, the rocking actuator 38 can be cycled to repetitively extend and retract the shaft 42. With the retaining pin 44 held in place, the other end of the rocking actuator 38 exerts a force on the rear motor tube 18, which rocks the seat plate 20 and back bracket 22 as the shaft 42 of the rocking actuator 38 extends and retracts. This cyclic motion can continue until the user stops the motion (such as with a push button that stops the rocking actuator 38). In some aspects, both the rocking actuator 38 and the locking actuator 54 are controlled with a control box and user-actionable buttons or controls.

In some aspects, when a user indicates a desire to move into an auto rocking motion, the control box may be programmed to position the retaining pin 44 in a position to align with the notch 74, before the actuator 54 is engaged to move the locking plates 60. This allows the locking plates 60 to better "capture" the retaining pin 44. Further, in some aspects, the control box may be programmed to oscillate the retaining pin 44 slightly as the actuator 54 moves the locking plates 60 towards the retaining pin 44, to allow the retaining pin 44 to properly center on notch 74 without binding. Still further, in auto rocking mode, to replicate a manual rocking motion, the control box may be programmed to pause actuator 38 at the upper and lower ends of the motion of shaft 42.

With the auto-rocker assembly 14, a user is allowed to rock the chair manually or to allow the rocking actuator 38 to provide the rocking motion for the user to provide a better user experience.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed:

1. A mechanism for a seating unit having a pair of spaced apart arms, a seat, and a back, comprising:

a stationary base configured to be coupled between the arms;

a rocker assembly supported on a portion of the stationary base;

a reclining mechanism coupled to the rocker assembly, the reclining mechanism configured to support the seat and the back of the seating unit; and an auto-rocker assembly having a first portion coupled to the stationary base and a second portion coupled to the reclining mechanism, the auto-rocker assembly comprising a rocking actuator, the auto-rocker assembly having a first state allowing the reclining mechanism to freely rock on the rocker assembly and a second state where the rocking actuator provides a powered rocking motion to the reclining mechanism on the rocker assembly, wherein the rocking actuator has a first end coupled to a portion of the reclining mechanism and a second end selectively coupled to a portion of the base, and wherein, when the second end of the rocking actuator is coupled to the base and the rocking actuator is activated, the rocking actuator provides the powered rocking motion to the reclining mechanism on the rocker assembly, and wherein the second end of the rocking actuator includes a pin on the end of an extendable and retractable shaft, the mechanism further comprising:

a mounting bracket coupled to the stationary base, the mounting bracket having spaced apart sides, at least one of the sides having a slot, wherein the pin of the rocking actuator resides within the slot; and wherein in the first state the pin travels freely within the slot, and in the second state, the pin is captured within the slot, such that operation of the rocking actuator moves the reclining mechanism, through the rocker assembly, with respect to the base.

2. The mechanism of claim 1, wherein the reclining mechanism includes a cross-tube and the first end of the rocking actuator is coupled to the cross-tube.

3. The mechanism of claim 1, further comprising:

a locking actuator having a first end coupled to the stationary base and a second end having an extendable and retractable shaft; and at least one locking plate coupled to the shaft of the locking actuator, the locking plate having a notch to receive the pin on the rocking actuator when the shaft of the locking actuator is extended, the notch capturing the pin such that it is not free to move within the slot.

4. The mechanism of claim 3, wherein the locking plate has a first angled surface extending upwardly away from the notch and a second angled surface extending downwardly away from the notch.

5. The mechanism of claim 4, wherein a pair of the locking plates are coupled to the shaft of the locking actuator, the pair of the locking plates being slidingly received within the mounting bracket.

6. The mechanism of claim 5, wherein locking actuator is selectively operable to move the pair of the locking plates into engagement with the pin of the rocking actuator.

7. The mechanism of claim 6, wherein the angle of the first angled surface with respect to a vertical line is different from the angle of the second angled surface with respect to a vertical line.

8. The mechanism of claim 7, wherein the first angled surface has a first length and the second angled surface has a second length, and wherein the second length is longer than the first length.

9. The mechanism of claim 8, wherein the pin is cylindrical and wherein the notch has a radius corresponding to the radius of the cylindrical pin.

10. A motorized mechanism for a seating unit having a pair of spaced apart arms, a seat, and a back, the mechanism comprising:

a stationary base;

a rocker assembly supported on a portion of the stationary base;

a reclining mechanism coupled to the rocker assembly, the reclining mechanism configured to support the seat and the back of the seating unit; and an auto-rocker assembly comprising:

a locking actuator coupled to the stationary base and having an extendable and retractable shaft; and a rocking actuator coupled to a portion of the reclining mechanism, the rocking actuator having an extendable and retractable shaft, wherein, with the shaft of the locking actuator in a first position, the locking actuator is disengaged from the rocking actuator, allowing the reclining mechanism to freely rock on the rocker assembly and, with the shaft of the locking actuator in a second position, the locking actuator is engaged with the rocking actuator, such that extension and retraction of the rocking actuator shaft provides a powered rocking motion to the reclining mechanism on the rocker assembly, wherein the rocking actuator includes a pin on the end of the shaft of the rocking actuator, and wherein with the shaft of the locking actuator in the second position, the locking actuator engages the pin of the rocking actuator to restrict the pin from movement.

11. The mechanism of claim 10, further comprising a mounting bracket coupled to the stationary base, the mounting bracket having spaced apart sides, at least one of the sides having a slot, wherein the pin of the rocking actuator resides within the slot; and wherein with the locking actuator in the first position the pin travels freely within the slot, and with the locking actuator in the second position, the locking actuator captures the pin within the slot, such that operation of the rocking actuator moves the reclining mechanism, through the rocker assembly, with respect to the base.

12. The mechanism of claim 11, further comprising at least one locking plate coupled to the shaft of the locking actuator, the locking plate having a notch to receive the pin on the rocking actuator when the locking actuator is in the second position, the notch capturing the pin such that it is not free to move within the slot.

13. The mechanism of claim 12, wherein a pair of the locking plates are coupled to the shaft of the locking actuator, the pair of the locking plates being slidingly received within the mounting bracket.

14. The mechanism of claim 13, wherein each locking plate has a first angled surface extending upwardly away from the notch and a second angled surface extending downwardly away from the notch.

15. The mechanism of claim 14, wherein the first angled surface has a first length and the second angled surface has a second length, and wherein the second length is longer than the first length.

16. The mechanism of claim 10, wherein, with the locking actuator in the first position, the reclining mechanism is freely moveable with respect to the stationary base, and with the locking actuator in the second position, the reclining mechanism is moveable with respect to the base only by engaging the rocking actuator.

* * * * *